US006477814B1

(12) United States Patent
Kadosh

(10) Patent No.: US 6,477,814 B1
(45) Date of Patent: Nov. 12, 2002

(54) MODULAR INTERLOCKING FRAMING ELEMENTS

(76) Inventor: Yoav Kadosh, 52 Kaplan St., Nahariya 22424 (IL)

( * ) Notice: Subject to any disclaimer, the term of this patent is extended or adjusted under 35 U.S.C. 154(b) by 0 days.

(21) Appl. No.: 09/688,385

(22) Filed: Oct. 17, 2000

(51) Int. Cl.[7] ..... E04C 1/00; E02B 3/14

(52) U.S. Cl. ..... 52/439; 52/604; 52/606; 52/DIG. 2; 405/284; D25/111; D25/122

(58) Field of Search ..... 52/604, 574, DIG. 2, 52/439, 284, 592.3, 592.6; 446/106, 124, 125, 476; D25/113, 114, 115, 118, 122; 405/16, 33, 286

(56) References Cited

U.S. PATENT DOCUMENTS

| | | | | | |
|---|---|---|---|---|---|
| 834,950 | A | * | 11/1906 | Van Wie | 52/589.1 |
| 1,894,605 | A | * | 1/1933 | Wright | D25/113 |
| 4,083,190 | A | * | 4/1978 | Pey | 405/33 |
| 4,441,298 | A | * | 4/1984 | Limousin | 52/604 |
| 4,481,155 | A | * | 11/1984 | Frohwerk | 52/604 |
| 4,651,485 | A | * | 3/1987 | Osborne | 52/284 |
| 4,990,116 | A | * | 2/1991 | Chen | 52/592.6 |
| 5,154,542 | A | * | 10/1992 | Klenert | 405/286 |
| 5,273,477 | A | * | 12/1993 | Adams, Jr. | 446/125 |

FOREIGN PATENT DOCUMENTS

| | | | | |
|---|---|---|---|---|
| AU | 496022 | * | 8/1977 | 52/DIG. 2 |

* cited by examiner

*Primary Examiner*—Michael Safavi
(74) *Attorney, Agent, or Firm*—Edward Langer

(57) ABSTRACT

A system of modular, hollow interlocking building elements which can absorb large horizontal or vertical pressures, and thus eradicate or minimize the effects of active pressure. The elements can be connected along each face and stacked one upon the other to form a stable, continuous, multi-directional structure, requiring no cement or other stabilizing material. The system comprises a plurality of base elements, having on slits on the vertical faces, and a plurality of interlocking elements to form layers above the base, having a slit in each of two, three or four vertical faces. The elements are arranged so that the faces having no slit form the outer surface, thus forming a structure having a smooth, continuous outer surface. The elements can be filled with any required filling material. The elements may be used in construction of structures in which active pressure is a factor, such as retaining walls, bridge abutments, ramps and the like.

17 Claims, 7 Drawing Sheets

MODULAR INTERLOCKING FRAMING ELEMENTS

FIELD OF THE INVENTION

The present invention relates to construction materials and methods and more particularly to a multi-directional, interlocking, hollow modular building element, designed to increase stability of load-bearing walls or structures and minimize active pressure.

BACKGROUND OF THE INVENTION

In building of load-bearing constructions involving filling materials, such as supporting walls, dams and artificial islands, the active vertical and horizontal pressure of the filling material must be taken into consideration. The width of the slope needed to absorb the active pressure exerted by the filling material is proportional to the height of the filling material.

In order to absorb active pressure and to prevent slippage, sinkage etc. of load-bearing constructions, various methods are used, such as rock terraces, or thick, heavy, retaining walls. These methods generally require the use of a large amount of building material, ground area and area of foundations.

Load-bearing retaining walls, supports and other similar structures have traditionally been constructed of concrete poured at the site, a process which is time-consuming and labor-intensive. To save time and expense, precast building blocks have been developed for use in erecting retaining walls, supports and the like, some of which are suggested for use in constructing a bridge abutment.

In U.S. pat. 4,982,544 to Smith, there is described a precast concrete module for use in constructing retaining walls capable of sustaining large vertical loads. In constructing a load-bearing wall using these modules stacked in rows, a stabilizing means is required, such as metal sheets inserted through slots in the rear connecting walls. The module described by Smith has a front wall, a partition wall, at least two front connecting walls and a rear connecting wall. The region between the front walls and the partition walls of the assembled modules is filled with poured concrete to create a load-bearing retaining wall. The step of pouring concrete is again time-consuming.

A particularly advantageous type of building block is that in which individual elements interlock, forming a secure, stable structure requiring little or no cement or other adhesive material, thus reducing the cost of material and time required for construction.

Several types of interlocking blocks have been described, including the following patents:

U.S. Pat. No. 5,181,362 to Benitez;

U.S. Pat. No. 5,588,271 to Rabassa;

U.S. Pat. No. 4,651,485 to Pitchford;

U.S. Pat. No. 5,379,565 to Vienne;

U.S. Pat. No. 4,514,949 to Crespo;

U.S. Pat. No. 4,573,301 to Schwartz,

U.S. Pat. No. 4,627,209 to Wilkinson,

U.S. Pat. No. 4,075,808 to Pearlman;

U.S. Pat. No. 4,031,678 to Shuring; and

U.S. Pat. No. 3,936987 to Calvin.

All of these describe a design in which blocks can be connected at their upper and lower surfaces and along two of their four vertical sides. This enables building of a construction having only one row of bricks in a horizontal direction, and not a continuous structure extending in all directions, thus limiting the load distribution, and ultimately the load-bearing capacity of the structure.

In addition, many of these interlocking blocks comprise a solid unit and do not have internal cavities to facilitate the placement of insulation, pipes or conduits. In such solid units, the use of filling material, which may be used to add weight to the modules, is prevented. This may be a particular disadvantage in the case of a retaining wall in which such filling could add weight to the modules to counteract the extrenal forces exerted on the rear of the wall.

An interlocking block and a retaining wall system derived from such blocks is described by Risi (U.S. Pat. No. 4,815,897). In this wall system, blocks are arranged in end to end relation and one upon the other in an overlapping manner, with projections on the upper surface of one layer fitting into recesses on the lower surface of the upper layer. This system does not have a very high level of stability and is not suited for bearing large vertical loads.

Therefore, it would be advantageous to provide an interlocking system of hollow, load-bearing building elements which can be used with or without filling material in mortarless construction of retaining walls, overhead passageways, artificial islands and the like.

SUMMARY OF THE INVENTION

Accordingly, it is an object of the present invention to overcome the disadvantages of the prior art and provide interlocking building elements which can absorb large horizontal or vertical pressures, and thus eradicate or minimize the effects of active pressure.

It is a further object of the present invention to provide interlocking building elements that can be connected along each face to form a stable, continuous, multi-directional structure, requiring no cement or other stabilizing material.

It is a further object of the present invention to provide elements which are hollow and can be filled with any required material.

In accordance with a preferred embodiment of the present invention, there is provided a system of modular interlocking building elements comprising a plurality of rigid, hollow polygonal elements having vertical faces, a first portion of said polygonal elements provided as base elements arranged as a base layer, a second portion of said polygonal elements provided as interlocking elements arranged as an intermediate layer above said base layer, a third portion of said polygonal elements provided as interlocking elements arranged as an upper layer above said intermediate layer, said interlocking elements in said intermediate layer being formed with a vertical slit in all of said vertical faces, said interlocking elements in said upper layer being formed with vertical slits in at least two of said vertical faces, such that said at least two vertical slits of each of said intermediate layer elements engage said base elements, and said at least two vertical slits of each of said upper layer elements engage said intermediate layer elements, said base, upper and intermediate layers providing a mortarless, multidirectional load-bearing construction.

According to a preferred embodiment, there is provided a series of interlocking, quadrilateral, hollow elements, each provided with vertical slits for engaging the upper half of the face of one or two similar modular elements. The interlocking elements form a continuous structure, which will counteract the active pressure exerted by any filling material.

Thus, the load exerted on the structure develops forces which are constrained within the element and these forces are not spread horizontally to the surrounding foundation.

A feature of the present invention is to provide modular elements for use in construction of structures in which active pressure is a factor, such as retaining walls, bridge abutments, ramps, dams, artificial islands, etc.

An advantage of the present invention is the minimization of active pressure, resulting in economization on filling material, ground area, area of foundations, etc.

A further advantage of the present invention is that the interlocking structure of the elements enables construction in all directions, permitting even load distribution and adding to the load-bearing capacity of the entire construction. The vertical and horizontal interlocking enables the construction of an even surface without the use of adhesive material between the elements.

The modular elements of the present invention may also be used as building construction elements without filling material, for example in the construction of overhead passageways.

Additional features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding sections or elements throughout, and in which.

DETAILED DESCRIPTION OF THE PREFERRED EMBODIMENTS

Figure 1:
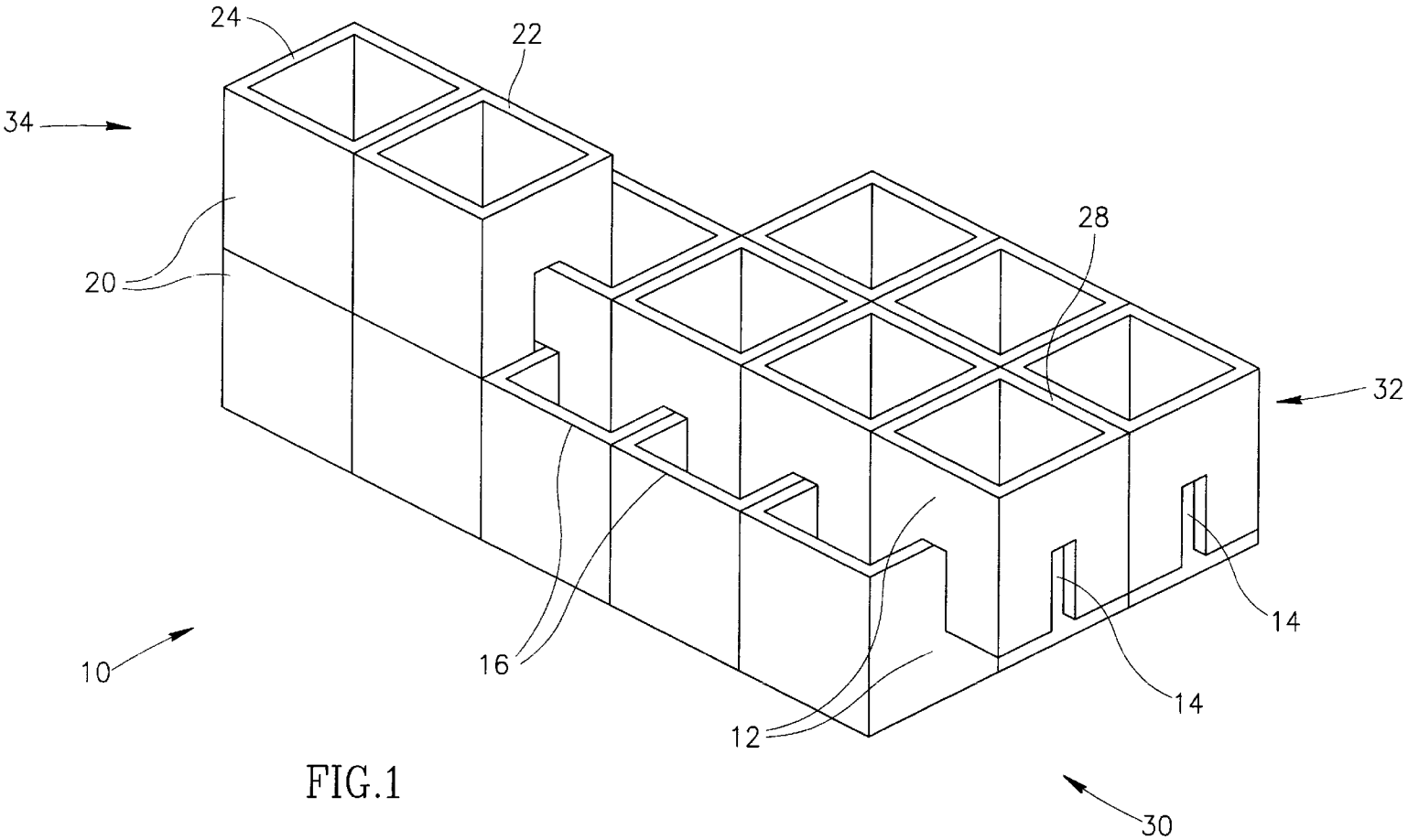
FIG. 1 is a general perspective view of a construction using the modular elements in three layers.

FIG. 1 shows a perspective view of a construction 10 using a series of modular elements 12. The elements 12 are hollow, quadrilateral framing elements, provided as blocks, typically known as construction blocks, having only vertical faces, with no upper or lower horizontal face. In a preferred embodiment of the present invention, the elements 12 are square, but other shapes, such as rectangles or polygonal shapes, by way of example, may be used. The elements 12 may be constructed, by way of example, from concrete, iron, or any other material appropriate to the present purpose. The blocks may be of any size, for example with faces having length between 0.2 meters up to several meters. variations of elements 12 are denoted as elements 16, 28, 22, and 24, as described in detail below.

FIG. 1 shows an incomplete construction 10 comprising a system of various quadrilateral elements 12. Vertical slits 14 are formed on the vertical faces of elements 12, extending upwards from the mid-point of the lower edge of the vertical face. The width of slits 14 is equivalent to double the width of the walls of element 12. The number of vertical slits 14 formed on the vertical faces of each element 12 may differ as described further below. Vertical slits 14 are designed to enable staggered interlocking arrangement of layers of elements.

The framing elements 16 which form the base layer of construction 10 have four smooth vertical faces 20 with no vertical slits. In building of construction 10, the elements 16 of base layer 30 are first arranged in the required formation. Elements 12 of second layer 32 are then positioned with slits 14, over the horizontal mid-point of the wall of an element 12 of the base layer 30, so that the wall of the lower element 16 becomes engaged within vertical slit 14 of the upper layer element 12. Since the width of slit 14 of element 12 is equivalent to double the thickness of the wall of lower element 16, element 16 is firmly and tightly engaged within slit 14.

Elements 28, having four slits 14 are used for placement over arrangements of four base elements 16, as further described below with reference to FIG. 5.

The elements 22 and 24, which are included in layers above the base, have respectively one and two smooth faces 20 having no slit 14. In this fashion, interlocking arrangement of elements 16, 22 and 24 on the outer perimeter can be achieved with faces 20 placed in an outward-facing position to produce a smooth, continuous, outer surface.

Element 22 is intended for placement so as to be surrounded on three sides by other elements 22 or 24, with only one face 20 forming an outer surface of construction 10. Corner element 24 is designed to be positioned with adjacent elements 22 or 24 on two sides, therefore leaving two surfaces exposed.

Subsequent layers are similarly constructed by appropriate use of the various elements 22, 24 and 28 in a stacked arrangement as desired to complete the construction.

Vertical slit 14 is of length equal to half the height of the vertical face in which it is formed, so that when three layers are interlockingly arranged one upon the other, the lower edge of the walls of the uppermost layer rests directly upon the uppermost edge of the lowest layer, thereby leaving no gap.

As will be further described below, the modular elements are hollow, enabling the addition of filling material as required.

Figure 2:
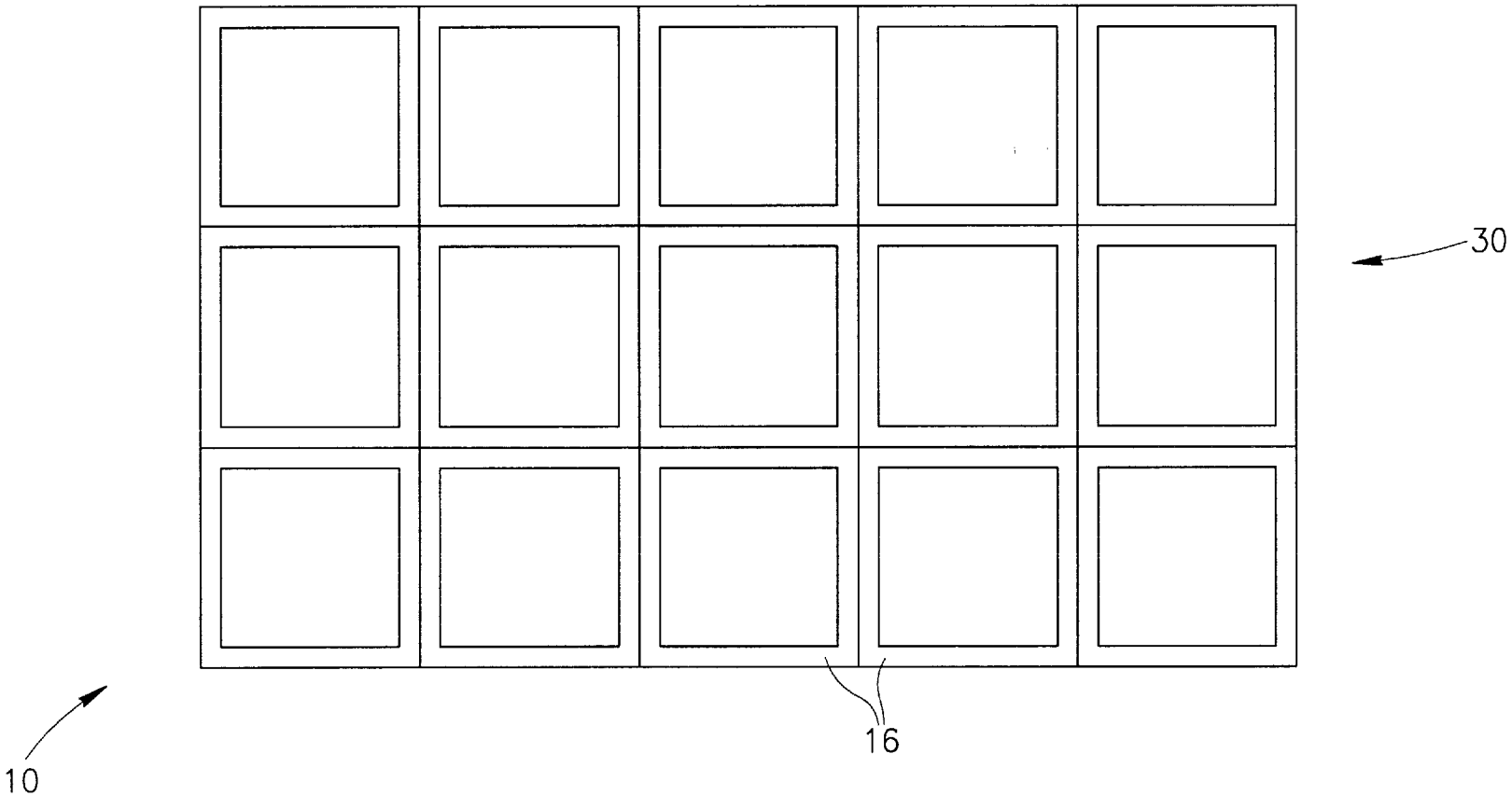
FIG. 2 is a top view of the modular elements forming a base layer.

Referring now to FIG. 2, a top view of the base layer 30 of the construction 10 is shown. A series of hollow, quadrilateral elements 16, having no vertical slits, are placed side by side in the required arrangement, which in this example forms a rectangular arrangement.

Figure 3:
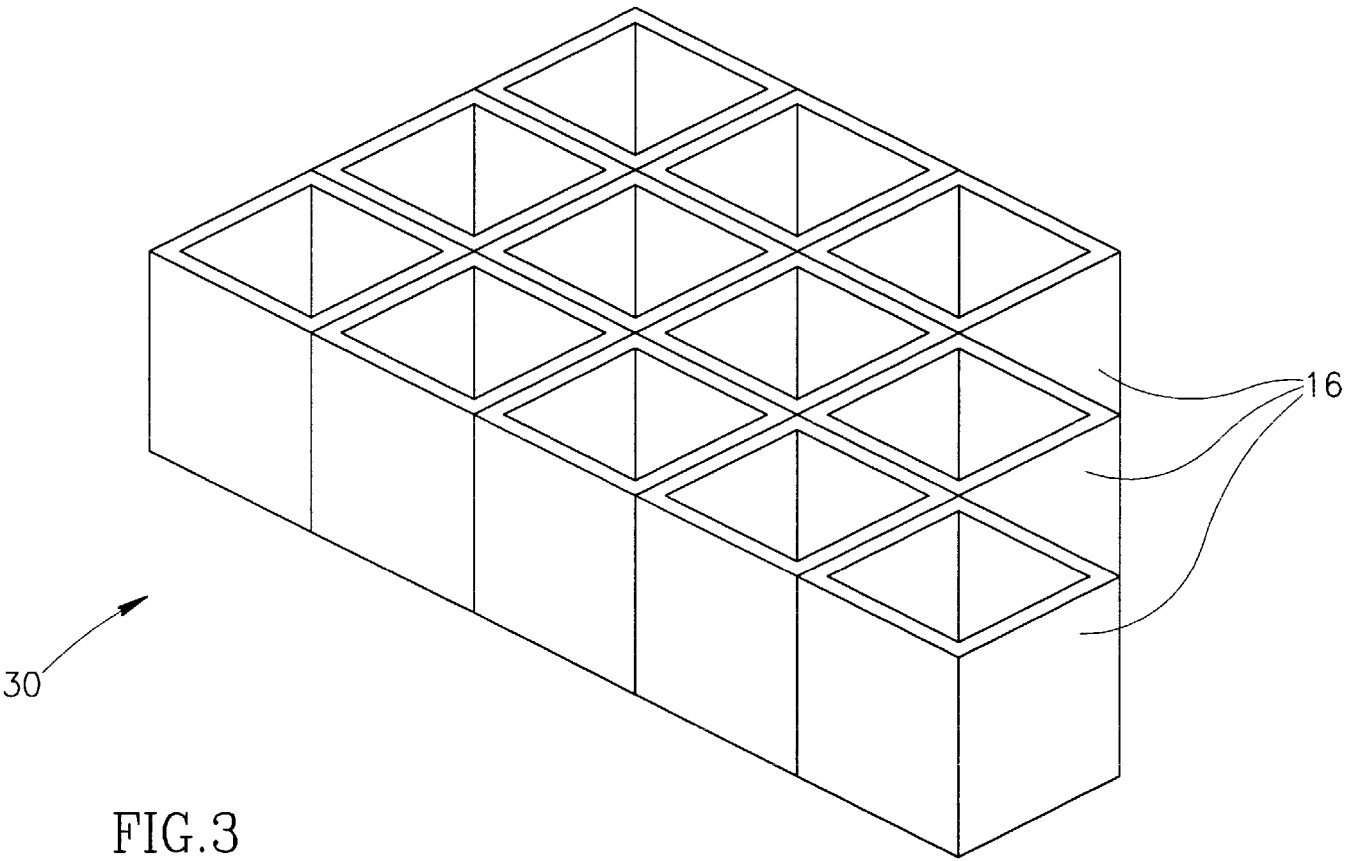
FIG. 3 is a perspective view of the modular elements forming a base layer.

FIG. 3 shows a perspective view of the elements 16 of base layer 30, arranged so as to form a construction having an irregular shape.

Figure 4:
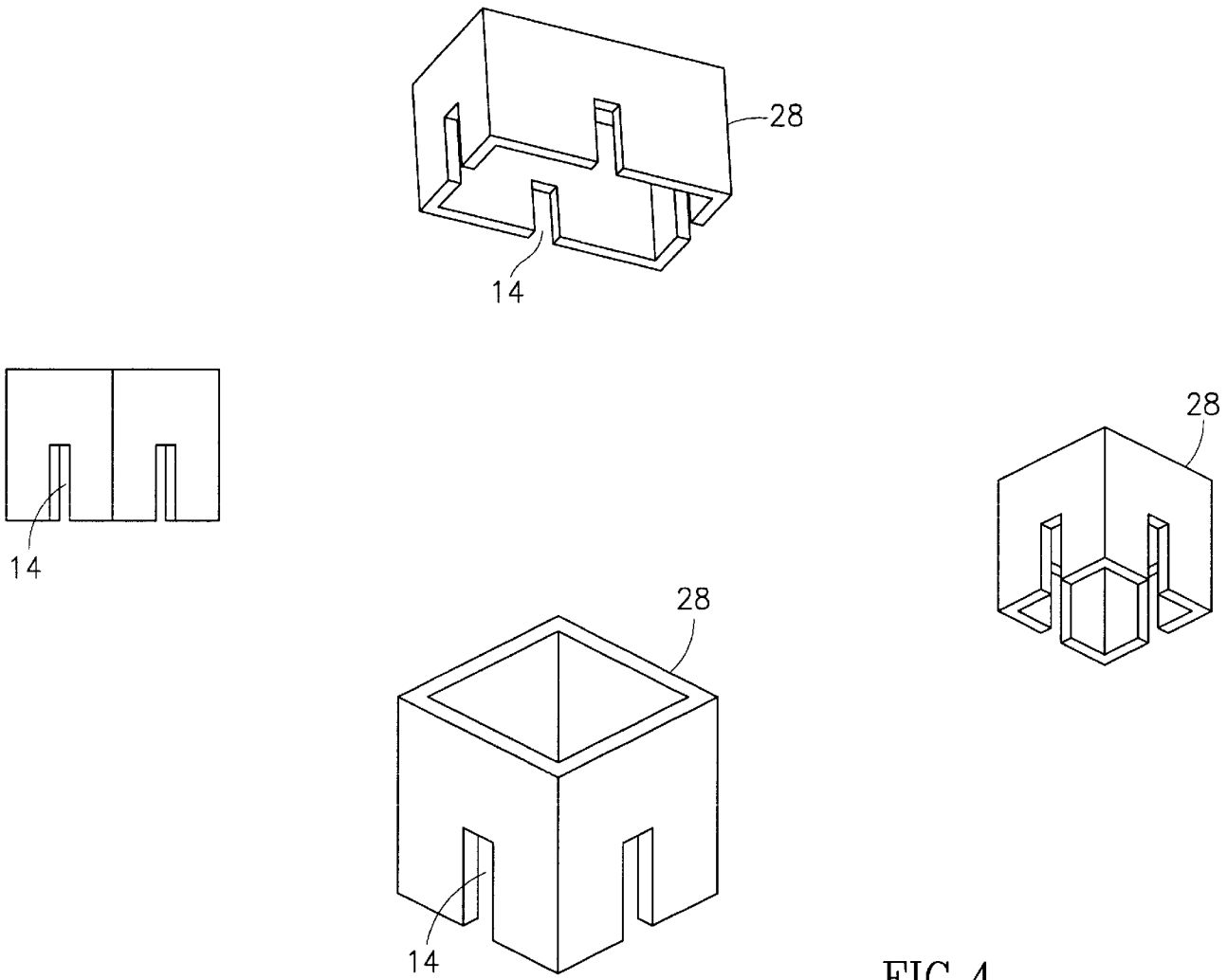
FIG. 4 is a perspective view of a modular element formed with four vertical slits.

FIG. 4 shows element 28, having a slit 14 on each of four vertical faces. Element 28 is designed to interlock with four elements 12, where the four elements 12 are arranged so as to form a square, so as to hold the four elements 12 in a stable arrangement, requiring no mortar or other stabilizing material. Element 28, which is used in intermediate layer 32, does not extend to the outer perimeter of construction 10. Element 28 is also used in the interior of upper layer 34, in which case elements 28 will be surrounded by elements 22 and 24, located on the outer perimeter.

Figure 5:
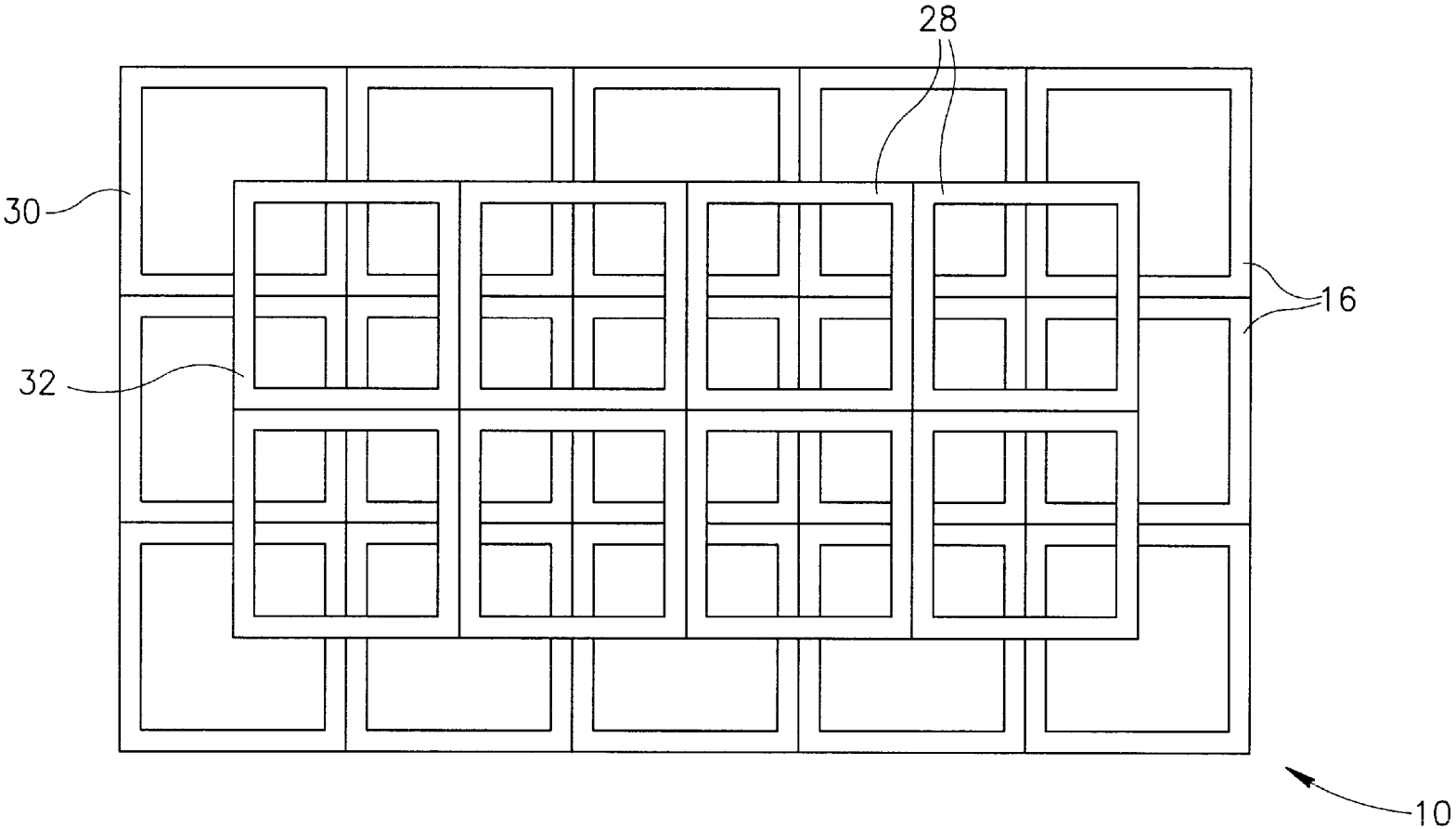
FIG. 5 is a top view of the modular elements forming two layers.

FIG. 5 shows construction 10, in which the elements 28 of the upper layer 32 are arranged upon the base layer 30. Elements 28 have a slit 14 in each of their four vertical faces. Each element 28 is placed over a group of four elements 16 arranged so as to form a square, so that the central point 36 of the square formed by the four elements 16 coincides with the central point of element 28. In this way, each slit 14 holds together a side of each of two adjacent elements 16 and four elements 16 of base layer 30 are held within each second-layer element 28.

Referring now to FIGS. 6*a–c* and FIG. 7, the individual modular elements are further illustrated.

Figure 6A:
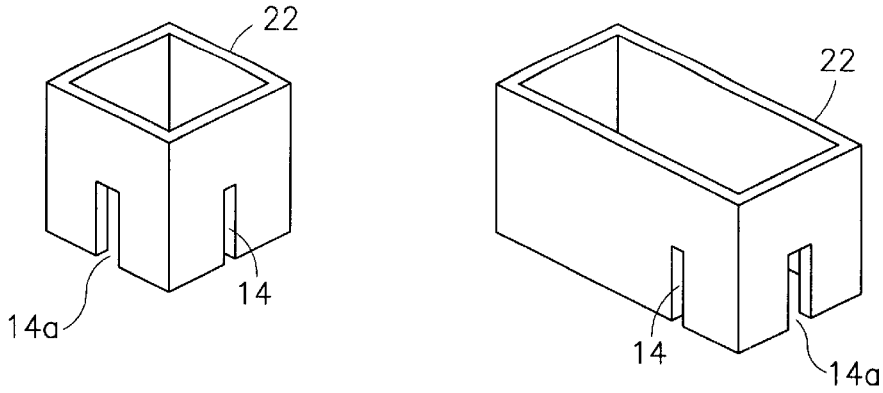
FIGS. 6*a* and 6*b* are perspective views of the modular elements formed with two slits and FIG. 6*c* is a perspective view of the modular elements formed with three slits.

FIG. 6*a* shows a modular element 22 having three slits, where slit 14*a* is designed to engage the walls of two adjacent lower level elements and is therefore double the width of slits 14 which engage only one lower level element wall. The shape of element 22 may be square or rectangular.

Figure 6B:
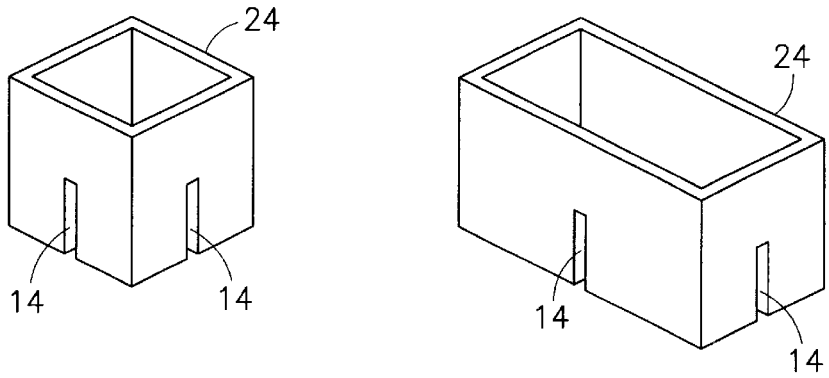

FIG. 6*b* shows modular corner element 24 having two slits 14, each of which engages one wall of a lower level element.

Figure 6C:
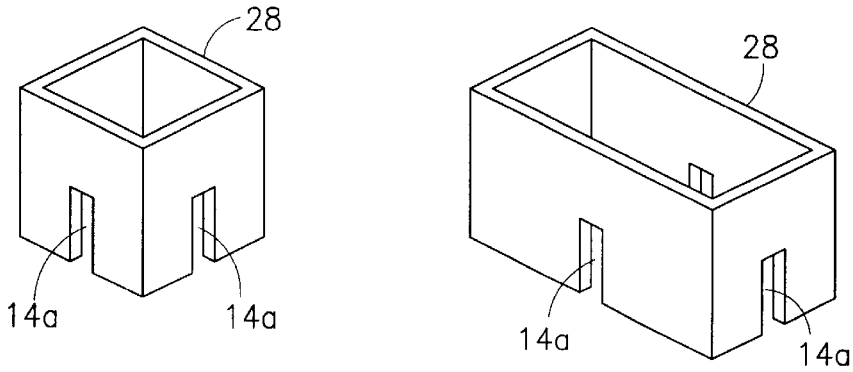

FIG. 6*c* shows modular element 28 having four slits 14*a*, each of which engage the adjacent walls of each of two lower level elements.

Figure 7:
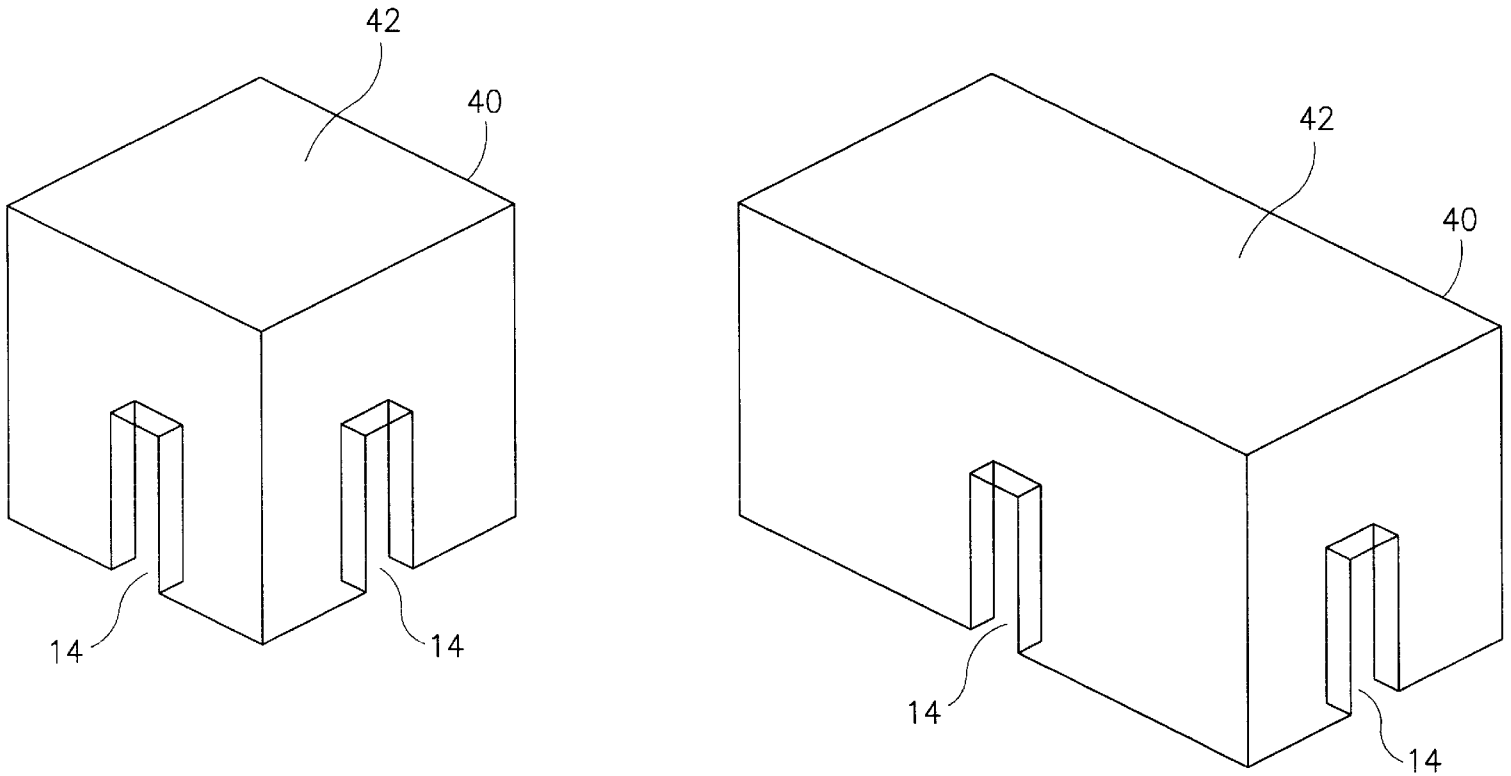
FIG. 7 is a perspective view of the modular elements of the uppermost layer.

FIG. 7 shows the modular elements 40 of the uppermost layer of construction 10, in which an upper horizontal surface 42 is provided, forming a closed upper surface.

The foregoing examples of constructions 10 illustrate the flexibility of the interlocking construction system of the present invention, whereby continuation of construction can proceed along the direction of any or all of the four faces of an element 12, as well as in an upward direction. The variations in the number of slits enables the various constructions to be formed having smooth, continuous, outer surface, if so required.

The hollow, framing structure of the elements enables the construction 10 to be filled after assembly with filling material, and to absorb or minimize the active generation generated thereby. Filling material may be used, for example, in the case of a retaining wall, to add weight to the elements to counteract forces exerted on the rear of the wall.

Alternatively, constructions without filling may be built, without filling, such as in the construction of overhead passageways. The design of the modules allows even weight distribution over the entire structure, thus creating a high load-bearing capacity.

Furthermore, the interlocking arrangement of elements results in a stable construction, without need for mortar or other stabilizing material, increasing the speed and efficiency with which the construction can be erected, and also reducing the overall cost of materials.

Many uses are envisaged for the modular construction elements of the present invention, such as retaining walls, ramps, artificial islands, overhead passageways etc. The system may also be used as bridge abutments. If the construction is to be built within a system of water, such as in a river, openings may be provided in the base layer of elements to enable passage of water.

Having described the invention with regard to certain specific embodiments thereof, it is to be understood that the description is not meant as a limitation, since further modifications will now suggest themselves to those skilled in the art, and it is intended to cover such modifications as fall within the scope of the appended claims.

I claim:

1. A system of modular interlocking framing elements capable of receiving filling material and absorbing the active pressure generated thereby, said system comprising:

a plurality of rigid, hollow polygonal framing elements each having a plurality of only vertical faces, joined at their edges, a first portion of said polygonal elements provided as base elements arranged as a base layer, a second portion of said polygonal elements provided as interlocking elements arranged as an intermediate layer above said base layer, a third portion of said polygonal elements provided as interlocking elements arranged as an upper layer above said intermediate layer, said interlocking elements in said intermediate layer each being formed with a single vertical slit extending upwards from the mid-point of the lower edge of each of said vertical faces, said vertical slit having height equal to half the height of said vertical face and width equivalent to the total thickness of two of the walls of said base layer elements to be inserted therein, said interlocking elements in said upper layer being formed with a single vertical slit extending upwards from the mid-point of the lower edge of at least two of said vertical faces said vertical slit having height equal to half the height of said vertical face, and width equivalent to the total thickness of two of the walls of said intermediate layer elements to be inserted therein, such that each of said vertical slits formed in said vertical face of said intermediate layer elements engages said base elements at a horizontal mid-point of said vertical face of said base elements, and each of said vertical slits formed in said vertical faces of each of said upper layer elements engages said intermediate layer elements at a horizontal mid-point of said vertical face of said intermediate layer elements, such that said base layer elements are aligned with said upper layer elements to form a smooth, continuous outer surface, said base, upper and intermediate layers providing a staggered, mortarless, multidirectional load-bearing construction.

2. The system of claim 1 in which said upper layer elements include a portion of elements having at least one smooth outer face to be arranged as an outer perimeter of said upper layer, such that said multidirectional load-bearing construction is formed with a smooth, continuous outer surface.

3. The system of claim 1 wherein a plurality of said upper layers are stacked upon a plurality of said intermediate layers in a staggered arrangement.

4. The system of claim 1 wherein said base elements are provided with openings for passage of water.

5. The system of claim 1 wherein said interlocking building elements are quadrilateral.

6. The system of claim 1 wherein said plurality of interlocking elements is formed with a vertical slit in each of two vertical faces.

7. The system of claim 1 wherein said plurality of interlocking elements is formed with a vertical slit in each of three vertical faces.

8. The system of claim 1 wherein said plurality of interlocking units is formed with a vertical slit in each of four vertical faces.

9. The system of claim 1 wherein said interlocking elements further comprise an upper horizontal surface.

10. The system of claim 1 wherein said interlocking elements are rectangular.

11. The system of claim 1 wherein said polygonal elements are each filled with filling material.

12. The system of claim 1 for use in construction of a retaining wall.

13. The system of claim 1 for use in construction of a ramp.

14. The system of claim 1 for use in construction of an artificial island.

15. The system of claim 1 for use in construction of a bridge abutment.

16. The system of claim 1 for use in construction of a dam.

17. The system of claim 1 for use in construction of an overhead passageway.

* * * * *